United States Patent [19]

Black et al.

[11] Patent Number: 4,622,784

[45] Date of Patent: Nov. 18, 1986

[54] PRESSURIZED WATERSTOPS

[76] Inventors: David A. Black, 9 Golf Crest Road, Islington, Ontario, Canada, M9A 1L2; John J. F. Deans, 352 Coxe Boulevard, Milton, Ontario, Canada, L9T 4N3

[21] Appl. No.: 683,228

[22] Filed: Dec. 18, 1984

[51] Int. Cl.[4] ..... E04F 15/14; E01C 11/10

[52] U.S. Cl. ..... 52/2; 52/396; 52/573; 404/64; 404/65

[58] Field of Search ..... 404/64, 65; 52/396, 52/573, 2

[56] References Cited

U.S. PATENT DOCUMENTS

| | | | |
|---|---|---|---|
| 2,333,826 | 11/1943 | Smith et al. | 52/396 |
| 2,901,904 | 9/1959 | Wey . | |
| 2,961,731 | 11/1960 | Buzzell et al. . | |
| 3,205,629 | 9/1965 | Rumley et al. | 52/396 |
| 3,342,033 | 9/1967 | Crouch et al. . | |
| 3,368,463 | 2/1968 | Jones . | |
| 3,524,390 | 8/1970 | Dill | 52/396 |
| 4,041,665 | 8/1977 | de Munck . | |
| 4,362,430 | 12/1982 | Ceintrey | 404/64 |

FOREIGN PATENT DOCUMENTS

| | | | |
|---|---|---|---|
| 564861 | 2/1958 | Belgium | 404/65 |
| 2054095 | 5/1972 | Fed. Rep. of Germany | 404/64 |
| 646268 | 11/1950 | United Kingdom | 404/65 |
| 927663 | 5/1963 | United Kingdom | 52/396 |

*Primary Examiner*—Carl D. Friedman
*Assistant Examiner*—Michael Safavi
*Attorney, Agent, or Firm*—Ridout & Maybee

[57] ABSTRACT

A waterstop for concrete structures, of the type consisting of an extruded strip of elastomeric material having a general flat medial portion extending between longitudinally ribbed side wing anchor portions is internally pressurized so as to compensate for dimensional changes of the concrete joint.

11 Claims, 4 Drawing Figures

PRESSURIZED WATERSTOPS

This invention relates to waterstops which are adapted to be installed in concrete structures, more particularly concrete hydraulic structures and thermal and nuclear structures.

Large and small concrete structures such as dams, walls etc. are generally placed in sections with vertical and horizontal joints between the sections, these usually being expansion or construction joints. Waterstops are sealing elements usually of elastomeric material which are installed in the concrete structures to seal the joints from air and water leakage, to permit expansion and contraction, and to seal the concrete to other structures.

A commonly used type of waterstop is disclosed in Canadian Pat. No. 495853 to R.W.S. Thompson, issued on Sept. 8, 1953. This comprises an elongate strip of elastomeric material, such as polyvinyl chloride, the strip being of uniform cross section throughout its length. The strip provides a generally flat medial portion extending between a pair of side wing anchor portions which are longitudinally ribbed on both sides so as to form integral keying means whereby the side wing anchor portions of the strip are firmly anchored into the respective sections of the concrete structure.

A difficulty which has been encountered with waterstops of this type is that they do not allow for shrinkage of the concrete in which they are embedded, or more generally they do not accommodate dimensional changes in the concrete sections and in consequence leaks develop around the seal. Dimensional changes in the waterstops due to shrinkage can also cause leakage.

Such leaks can cause serious failure of the joints.

It is an object of the present invention to provide an improved waterstop which, while being of the general type referred to above, can be installed so as to compensate for dimensional changes in the concrete or in the waterstop and thereby maintain the seal at the joint.

According to one aspect of the present invention, a waterstop for use in concrete structures consists of an elongate strip of elastomeric material, such as polyvinyl chloride for example, the strip being of uniform cross-section throughout its length and having a medial portion extending between side wing anchor portions. The strip is formed with a plurality of internal cavities extending throughout its length, the cavities being transversely separated by thin wall sections capable of being pierced by a piercing tool thereby to interconnect the cavities for equalizing fluid pressure therein When the waterstop is used in a concrete installation, it is internally pressurized from an external gas source, or alternatively an external source of grouting material. Thus, according to another aspect of the invention, there is provided in a concrete structure providing a joint between two adjacent sections thereof, a waterstop extending along the joint to provide a seal thereat, the waterstop comprising an elongate strip of elastomeric material of uniform cross section throughout its length and being formed with a plurality of longitudinally extending cavities, the cavities being transversely separated by thin wall sections which are pierced thereby to interconnect the cavities for equalizing fluid pressure therein, and means for supplying fluid under pressure into the cavities whereby to expand the waterstop into sealing engagement with the concrete in which it is embedded.

In order that the invention may be readily understood, waterstops of different configurations will now be described, by way of example, with reference to the accompanying drawings. In the drawings.

Figure 1:
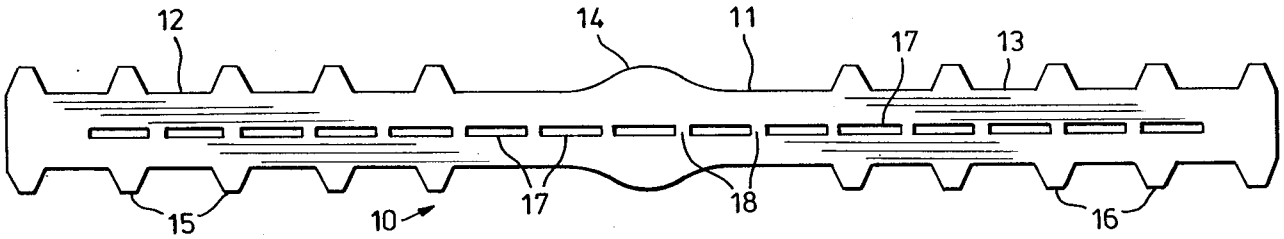
FIG. 1 is an end view of a first waterstop in accordance with the invention, showing its cross-sectional configuration.

Referring to FIG. 1, the waterstop comprises an elongate strip 10 of elastomeric material such as polyvinyl chloride, the strip having a uniform cross-sectional configuration throughout its length. The strip, being extruded as is generally the case, is of indefinite length so that, on installation, suitable lengths can be cut and spliced end to end in accordance with common practice. The strip 10 provides a medial portion 11 which extends transversely between a pair of side wing anchor portions 12, 13. The strip 10 is generally flat except that its opposite sides are configured as follows. The medial portion 11 is formed with a longitudinally extending central bulge 14 which merges smoothly into the adjacent flat portions of the strip. The side wing anchor portions 12, 13 are longitudinally ribbed on both sides; the ribs 15, 16 are transversely spaced as shown, and are of the same height.

The central feature of the present invention is that the strip is formed with a plurality of internal cavities 17 extending throughout its length. As shown in FIG. 1, the cavities are of flattened rectangular cross section and lie in the medial plane of the strip. The cavities are spaced substantially uniformly across the full width of the strip, and are transversely separated by thin wall sections 18. For the purpose of pressurizing the waterstop when it is installed, the thin wall sections 18 are capable of being pierced so as to interconnect the cavities 17. By piercing an edge of the strip an inlet for connection to a gas pressure supply is made.

Figure 2:
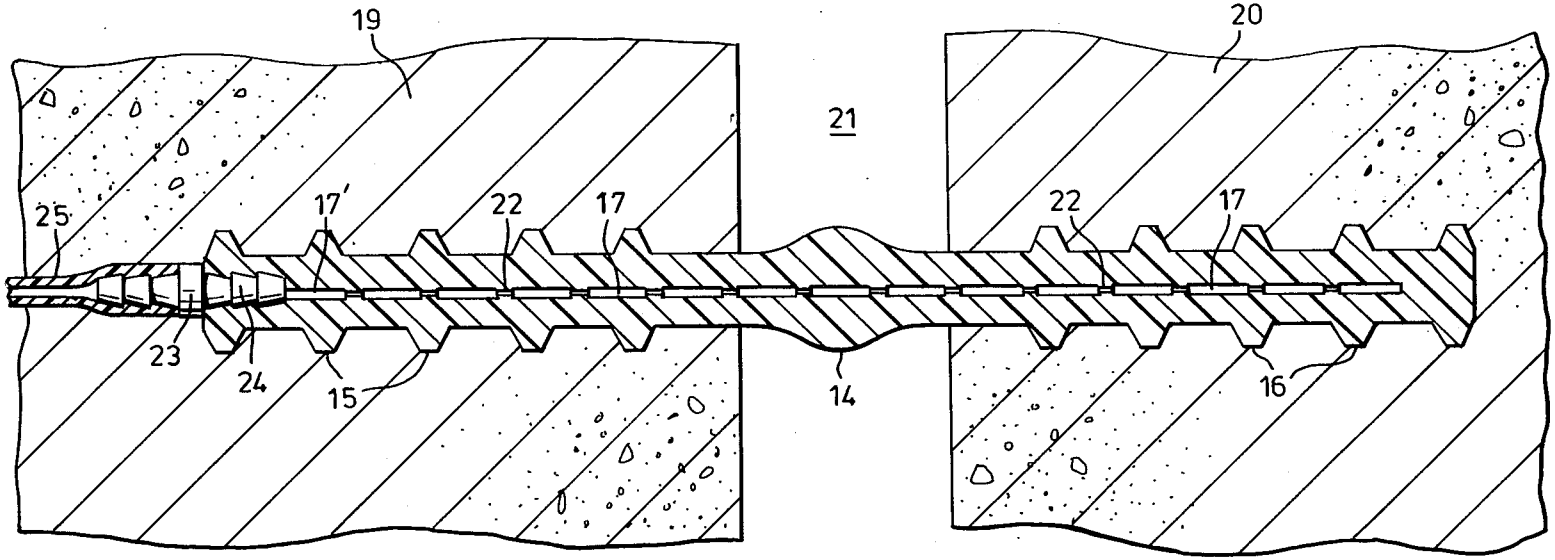
FIG. 2 is a cross-sectional view of an expansion joint with the waterstop of FIG. 1 installed.

FIG. 2 shows such a waterstop installed in a concrete structure to provide a seal at the vertical expansion joint. The joint is formed between two adjacent concrete sections 19, 20 whose respective vertical faces define a space 21 to accommodate expansion at the joint. The waterstop 10, being the waterstop of FIG. 1, is installed so that the side wing anchor portions 12, 13 are embedded in the concrete of the sections 19, 20 so as to be firmly anchored therein. The ribs 15, 16 serve as keying members for keying the side wing anchor portions in the concrete. The bulged part, or the central bulb 14, of the medial portion extends along the joint within the space 21.

In the installation of FIG. 2, the thin wall sections 18 have been pierced to form transverse passages 22 which interconnect the cavities 17 across the width of the waterstop. The outermost cavity referenced 17' in FIG. 2 is connected directly to a pressurized gas supply by a hose connection 23, the latter having a spigot 24 which is inserted in an inlet opening at the edge of the anchor portion 12. This inlet opening can be preformed, but it is preferred that it be made at the construction side simply by cutting an edge opening at the required position. In practice one will cut the opening to the depth at which it reaches the outermost cavity 17', and thereafter one will insert a suitable piercing tool so as to pierce all the thin wall sections 18 across the width of the strip. Thus, in the installed waterstop, the passages 22 are transversely aligned with one another and with the inlet opening, thereby to interconnect the cavities 17 for equalizing gas pressure therein. The waterstop is interconnected with a pressurized gas supply, as described with reference to FIG. 3, by a hose or the like 25.

Figure 3:
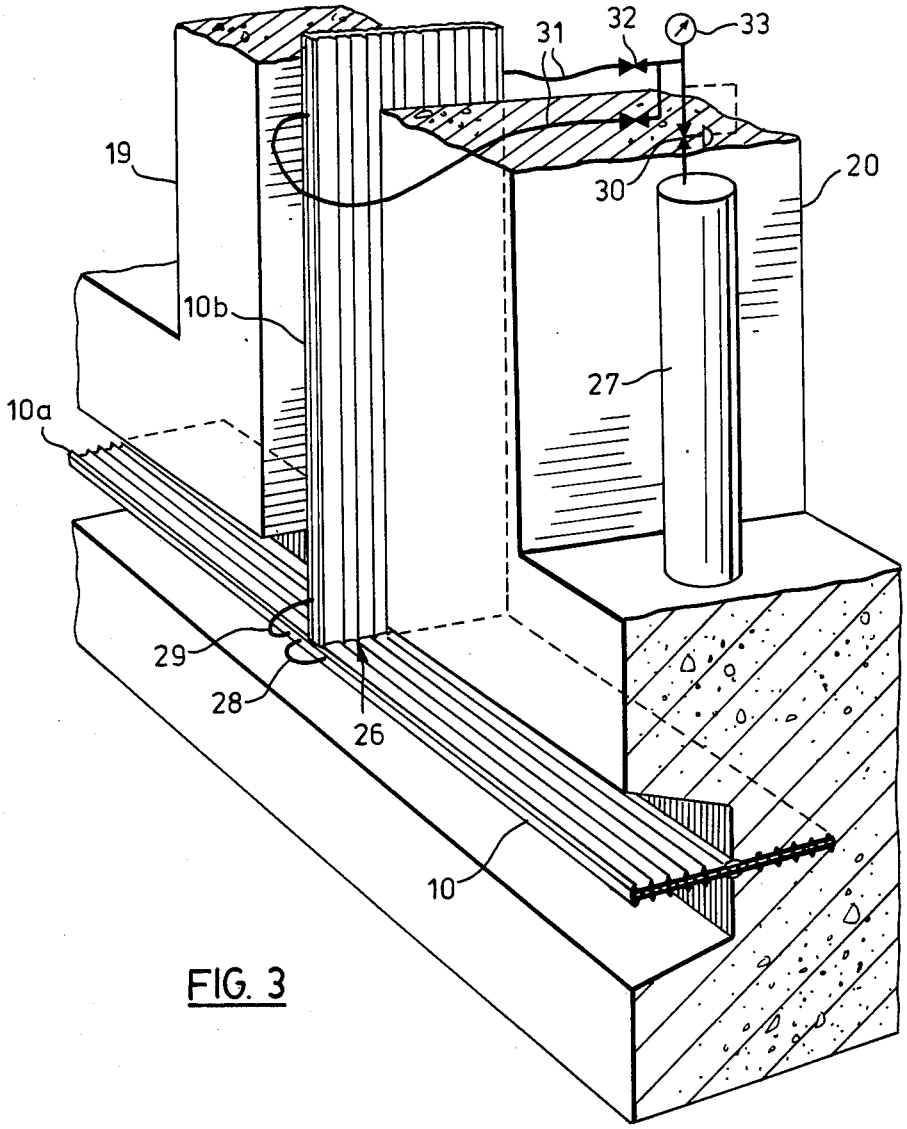
FIG. 3 is a broken away perspective view of an expansion joint, such as the expansion joint of FIG. 2, with waterstops installed.

FIG. 3 illustrates a suitable system for internally pressurizing waterstops of the type under consideration. In the more complex joint shown, the waterstop arrangement comprises three waterstop sections 10, 10*a* and 10*b* which are spliced together at a T-joint 26. The internal cavities of each strip are interconnected as previously described, and the cavities of one of the strips 10*b* are interconnected with a pressurized gas source 27. The internal cavities of the different strips are interconnected with one another by connecting loops 28, 29 which provide gas flow passages bypassing the obstruction of the splice 26. The gas source 27 is a gas cylinder having an outlet 30 which, via a system of hoses 31 incorporating pressure regulating valves 32 and a pressure gauge 33, is connected to the gas inlets of the waterstop strip 10*b*.

Figure 4:
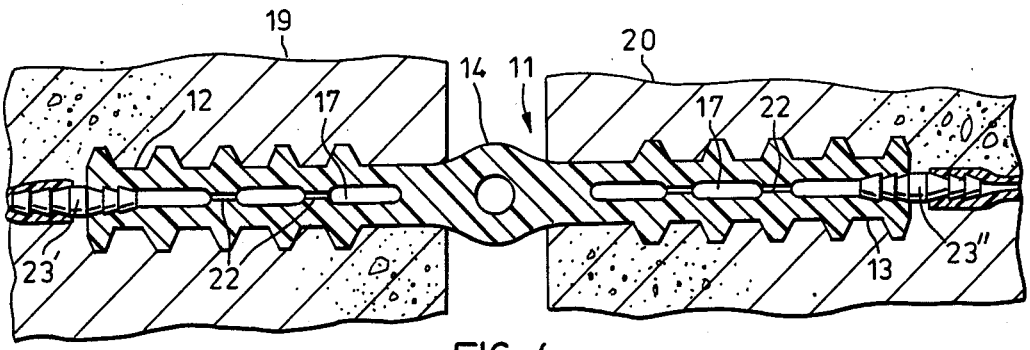
FIG. 4 is a cross-sectional view of an expansion joint similar to that of FIG. 2, but with a second form of waterstop installed.

In the case of waterstops having the configuration shown in FIGS. 1 and 2, it is sufficient to have one gas inlet to the internal cavities, since all the cavities are interconnected. However, for certain waterstop configurations in accordance with the invention it is necessary to provide gas inlet connections at opposite edges of the strip, as shown in FIG. 3. FIG. 4 shows such a waterstop configuration.

Referring to FIG. 4, the waterstop is formed with a medial portion 11 having a central bulge 14, and a pair of longitudinally ribbed side wing anchor portions 12, 13 which are keyed into the concrete sections 19, 20, However, the central bulge 14 is formed as a hollow bulb which, since it is not constrained by the concrete, must not be internally pressurized. As in the preceding example the internal cavities 17 are transversely separated by thin wall sections 18, the latter being pierced to provide transverse interconnecting passages 22. In the present case, however, the cavities are not uniformly spaced across the width of the strip but fall into two groups, one group on each side of the hollow bulb 14. The cavities of each group are interconnected as shown, the groups remaining separated and being connected to the pressurized gas supply by respective hose connections 23', 23''.

Although the invention has been described with particular reference to waterstops which are internally pressurized by gas, it is to be understood that the waterstops may alternatively be internally pressurized by fluids other than gas. In particular, a liquid grouting material may be used. Thus, if a leak should develop at the joint after the waterstop has been installed, owing to shrinkage of the waterstop or of the concrete, a grouting material may be pumped into the waterstop under pressure whereby to expand the waterstop into sealing engagement with the concrete in which it is embedded. The pressure is maintained until the grout has set. While this procedure precludes subsequent internal pressurization of the waterstop, the risk of subsequent shrinkage is minimal.

What we claim is:

1. A waterstop for use in concrete structures consisting of an elongate strip of elastomeric material, the strip being of uniform cross section throughout its length and having a medial portion extending between side wing anchor portions, wherein the strip is formed with a plurality of internal cavities extending throughout its length, the cavities being transversely spaced by thin wall sections which are pierced to provide transverse passages which interconnect the cavities for equalizing fluid pressure therein, and said side wing anchor portions providing inlet means for interconnecting the cavities with a fluid supply for internally pressurizing the waterstop.

2. A waterstop according to claim 1, wherein the cavities are of flattened cross section and lie in the medial plane of the strip.

3. A waterstop according to claim 2, wherein the cavities are spaced substantially uniformly across the full width of the strip.

4. A waterstop according to claim 1, wherein the side wing anchor portions of the strip are longitudinally ribbed.

5. A waterstop according to claim 1, wherein the medial portion of the strip is formed with a centre bulb.

6. A waterstop according to claim 5, wherein the center bulb is hollow.

7. In a concrete structure providing a joint between two adjacent sections thereof, a waterstop extending along the joint to provide a seal thereat, the waterstop comprising an elongate strip of elastomeric material of uniform cross section throughout its length and being formed with a plurality of longitudinally extending cavities, the cavities being transversely spaced by thin wall sections which are pierced thereby to interconnect the cavities for equalizing fluid pressure therein, and means for supplying fluid under pressure into the cavities whereby to expand the waterstop into sealing engagement with the concrete in which it is embedded.

8. A structure according to claim 7, wherein the means for supplying fluid under pressure into the cavities comprises a pressurized gas source having an outlet connected to the waterstop by a hose connection and incorporating a pressure regulating valve.

9. A structure according to claim 8, wherein said elongate strip is configured to provide a medial portion extending between longitudinally ribbed side wing anchor portions embedded in the concrete of said sections.

10. A structure according to claim 9, wherein said two adjacent sections are spaced to provide an expansion joint, and wherein the medial portion of the strip is formed with a hollow centre bulb isolated from said internal cavities by internal wall means.

11. A structure according to claim 8, wherein a side wing anchor portion is formed with an inlet opening communicating with the internal cavities, the hose connection being connected to said inlet opening by a pressure fitting.

* * * * *